US006434182B1

(12) United States Patent
Kohler

(10) Patent No.: US 6,434,182 B1
(45) Date of Patent: Aug. 13, 2002

(54) COMPOSITE INSULATING CLAMP ASSEMBLY FOR INDUCTION FURNACE

(75) Inventor: Mark L. Kohler, Hartville, OH (US)

(73) Assignee: Lecrotherm, Inc., North Canton, OH (US)

( * ) Notice: Subject to any disclaimer, the term of this patent is extended or adjusted under 35 U.S.C. 154(b) by 0 days.

(21) Appl. No.: 09/863,959

(22) Filed: May 23, 2001

(51) Int. Cl.[7] ..... H05B 6/22; H05B 6/16
(52) U.S. Cl. ..... 373/153; 373/160
(58) Field of Search ..... 373/138, 151, 373/152, 153, 156, 160; 248/317, 340, 610–613, 58, 62, 589

(56) References Cited

U.S. PATENT DOCUMENTS

| | | | | |
|---|---|---|---|---|
| 2,667,949 A | | 2/1954 | Shupe | |
| 2,695,387 A | | 11/1954 | Clark et al. | |
| 2,755,326 A | | 7/1956 | Kennedy | |
| 3,190,948 A | | 6/1965 | Kugler | |
| 3,704,336 A | | 11/1972 | Synnestvedt | |
| 3,944,715 A | | 3/1976 | Hegewaldt et al. | |
| 4,236,139 A | * | 11/1980 | Haglund | 373/153 |
| 4,622,679 A | | 11/1986 | Voss | |
| 5,247,539 A | | 9/1993 | Gillhaus | |
| 5,430,425 A | | 7/1995 | Alber et al. | |

FOREIGN PATENT DOCUMENTS

SU 1336125 A1 6/1985

* cited by examiner

*Primary Examiner*—Tu Ba Hoang
(74) *Attorney, Agent, or Firm*—Sand & Sebolt

(57) ABSTRACT

A clamp assembly for securing a plurality of windings of an induction coil in a fixed position includes a T-shaped latch bar formed of high strength insulating material. The T-shaped latch bar has a stem and a cross member. The stem is secured to a second winding of three end windings, which preferably is located between the terminal or endmost winding of the coil, and the third winding, by a pair of stud bolts which are welded on the second winding. The cross member extends in an axial direction between the three windings. A pair of lugs are welded onto the terminal winding and the third winding. The ends of the cross member are formed with a pair of notches into which the lugs are seated for stabilizing the terminal winding and the adjacent two windings.

19 Claims, 5 Drawing Sheets

FIG-2
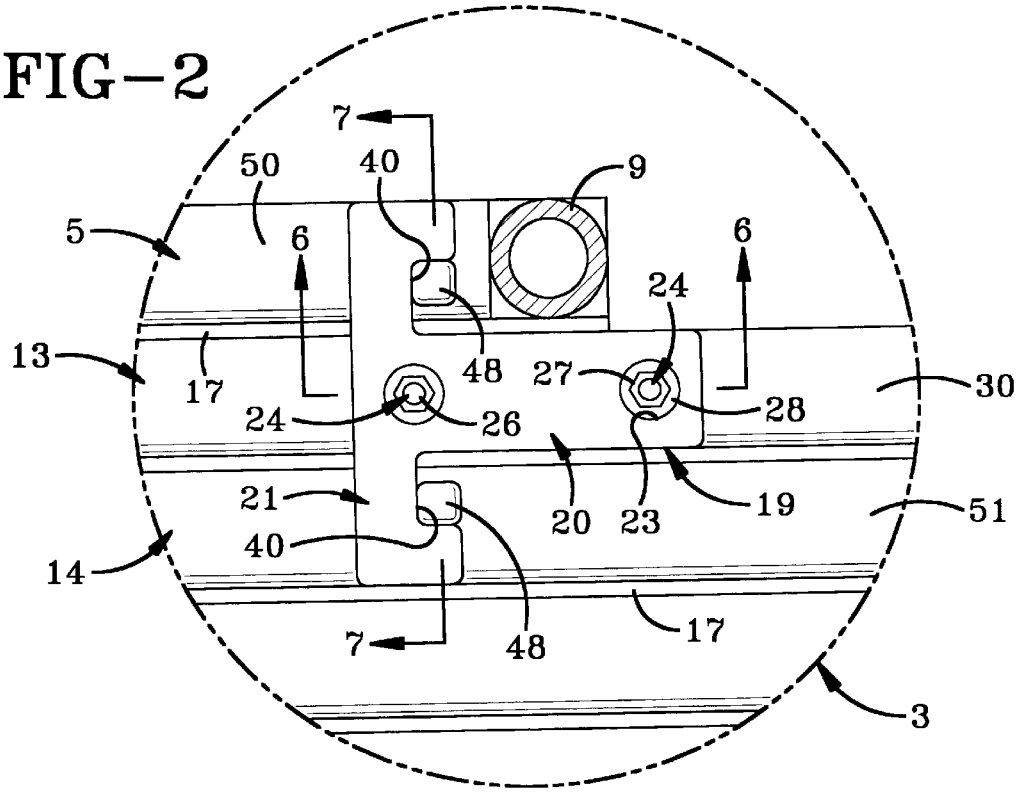
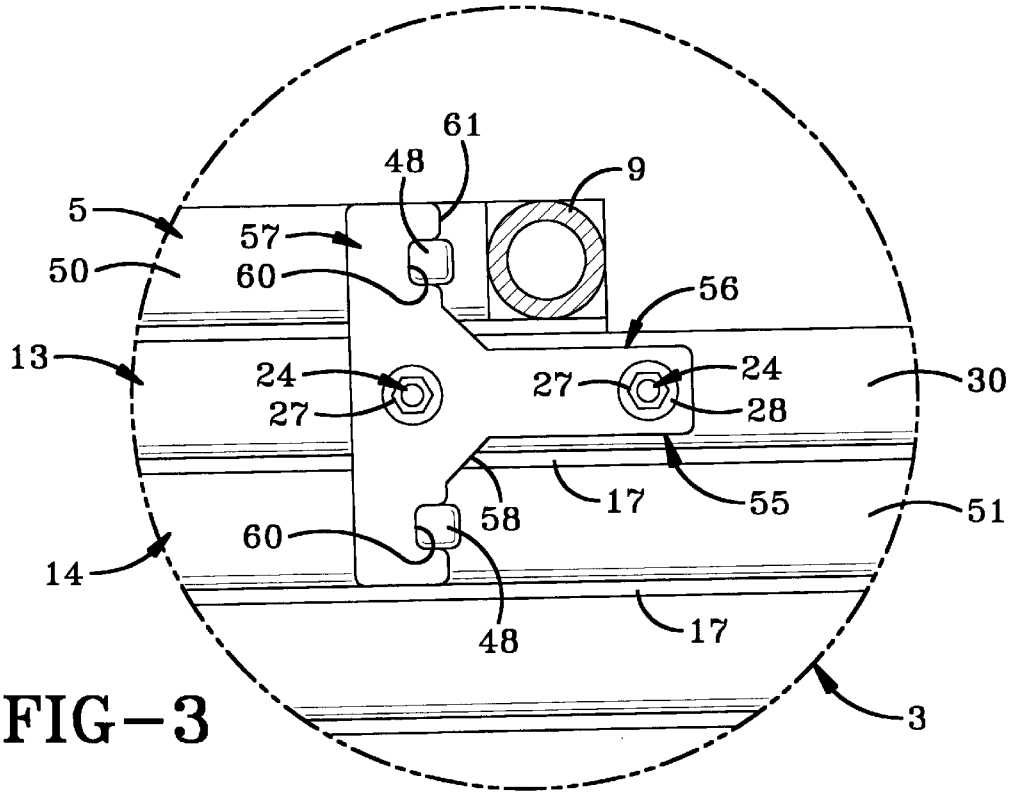
FIG-3

COMPOSITE INSULATING CLAMP ASSEMBLY FOR INDUCTION FURNACE

BACKGROUND OF THE INVENTION

1. Technical Field

The invention relates to induction melting and heating applications such as electrical furnaces and in particular to a composite insulated clamp assembly for securing selected windings of an induction coil in a fixed position.

2. Background Information

The windings of an induction coil of frequency melt equipment, and in particular the terminal or end winding must be maintained in a secured position at the start and end of the coil to prevent unwanted expansion and movement of the coil with respect to the material receiving vessel. A tie-bolt assembly is presently used today on many types of induction furnaces for this purpose, but possesses a number of possible inherent problems. These tie-bolt assemblies are fixed to the top and bottom windings or turns in the coil and are usually located directly adjacent to and in contact with the poured cast rings and the backside of the refractory lining in the free board areas of the furnace as well as the bottom cast ring beneath the coil that supports the working furnace lining. These locations of the tie-bolt assembly subject the insulators at the top and bottom sides of the coils to a direct thermal transfer from the hot cast rings as well as from the back side of the furnace liner. The tie-bolt assembly is secured to the second winding of the coil with a tie-in lug which is usually a large mass of copper welded to the top of the second winding of the coil. This copper mass is far from the coolant path of the coil and is extremely thermally conductive and will soak up heat from the cast ring and lining contributing to the total heat load of the tie-bolt assembly. These tie-bolts are supported on insulators which are subjected to thermal degradation and can lead to burning or charring and create an arc over from the tie-bolt resulting-n tie-bolt failure.

Another problem with such tie-bolt assemblies is that they are subjected to radial stress on the insulator since the bottommost turn of the coil is subjected to the greatest degree of head pressure from the molten bath and consequently, the highest degree of radial stress. This can fracture and split the insulator supporting the tie-bolt assembly or cause cracks which subjects the insulator to possible arcing.

Still another problem that exists with such insulated supported tie-bolts occurs form radial flux. The position of the standard tie-bolt assembly, and in particular the copper lug which is welded to the second winding or turn at each end of the coil, places each lug behind a magnetic yoke which puts a large mass of copper directly in the path of the concentrated radial flux lines entering the shunt. This causes the copper block or lug to become inductively heated which exceeds the permissible temperature on the insulator, which combined with the thermal transfer from the hot cast rings of the furnace, contributes to the fracturing or cracking of the insulator.

SUMMARY OF THE INVENTION

The present invention provides a clamp assembly for the coil of an induction furnace which avoids the thermal degradation, radial stress and radial flux experienced by prior art end winding terminations, such as the tie-bolt assembly commonly used on many types of induction coils.

The clamp assembly of the invention comprises a T-shaped latch bar which is formed of a high temperature, high strength, high dielectric, high pressure, glass reinforced laminate insulating material which has one or more holes in the stem portion of the T-shaped bar for securing the bar to one of the windings of the induction coil.

Another aspect of the invention provides a pair of studs formed of relatively small masses of copper or other metal, welded to coil windings adjacent to the winding along which the stem of the latch bar extends. These lugs are received in notches formed in the cross member of the T-shaped latch bar and absorb the radial stress loads and strain on an adjacent power connection.

A further feature of the invention is the placement of the T-shaped latch bar on the face of three adjacent windings where it is kept relatively cool by the cooling water which flows through the interior of the induction coil windings.

Another aspect of the invention is the location of the T-bar on the outer face of the coil which isolates it from the cast rings or furnace linings, thereby avoiding exposure to the heat generated thereon, and since the two securing lugs are located on the face of two spaced windings they are not subjected to radial flux and thus will not inductively heat and cause thermal degradation of the T-shaped insulated latch bar.

Still another important aspect of the present invention is that the T-shaped latch bar can be used with many types of induction furnaces requiring only minor modifications thereto thereby enabling it to be used on new coils or retrofitted onto existing coils.

The foregoing advantages, construction and operation of the present invention will become more readily apparent from the following description and accompanying drawings.

BRIEF DESCRIPTION OF THE DRAWINGS

The preferred embodiments of the invention, illustrative of the best mode in which applicant contemplates applying the principles, are set forth in the following description and are shown in the drawings and are particularly and distinctly pointed out and set forth in the appended claims.

FIG. 2 is an enlarged elevational view of the encircled portion of FIG. 1;

FIG. 3 is similar to FIG. 2 showing a modified embodiment of the clamping assembly;

Similar numerals refer to similar parts throughout the drawings.

DESCRIPTION OF THE PREFERRED EMBODIMENTS

Figure 1:
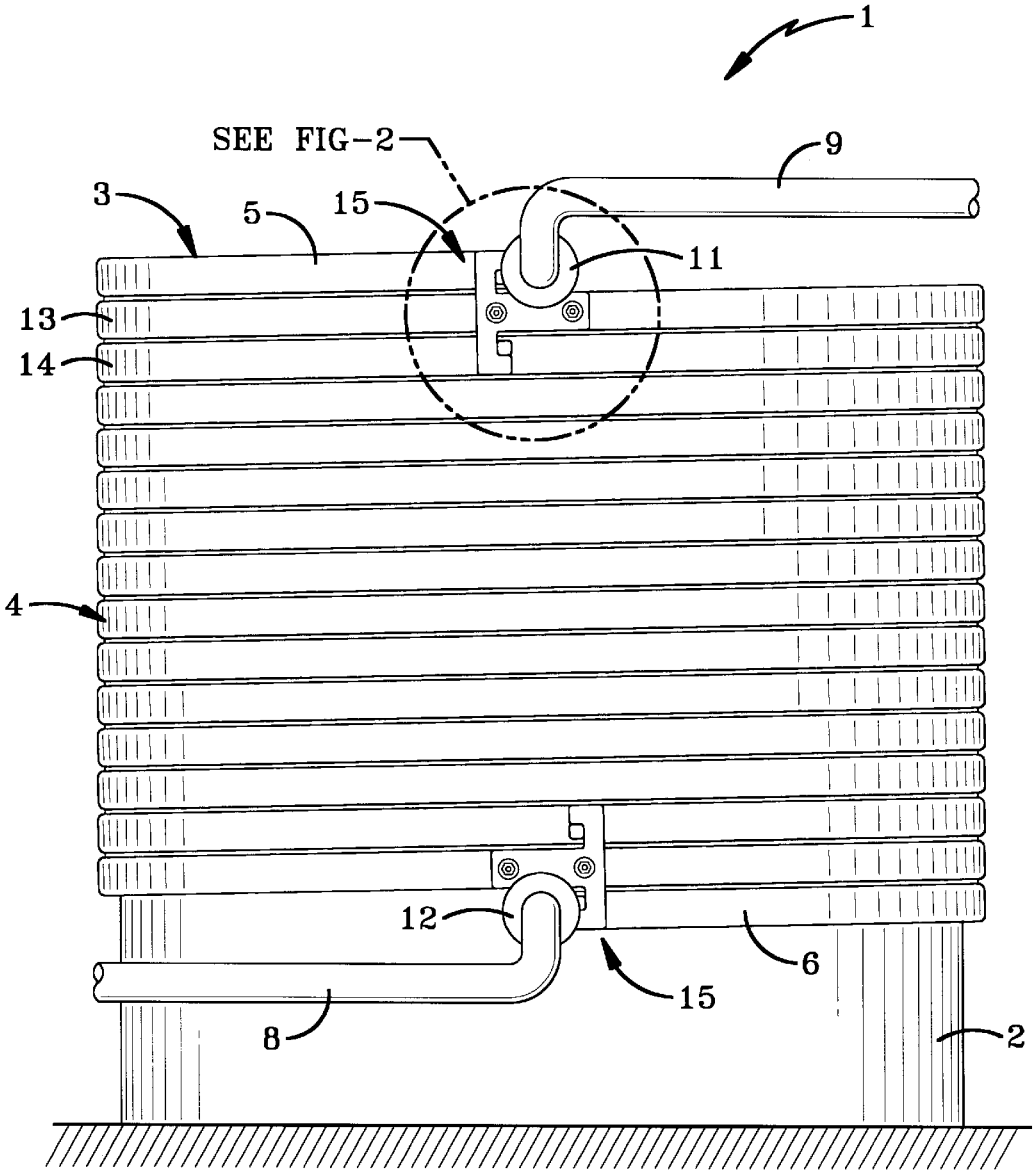
FIG. 1 is a diagrammatic elevational view of an induction furnace having an induction coil formed by a plurality of windings with the improved clamping assembly securing the end winding to the adjacent second and third windings.
Figure 4:
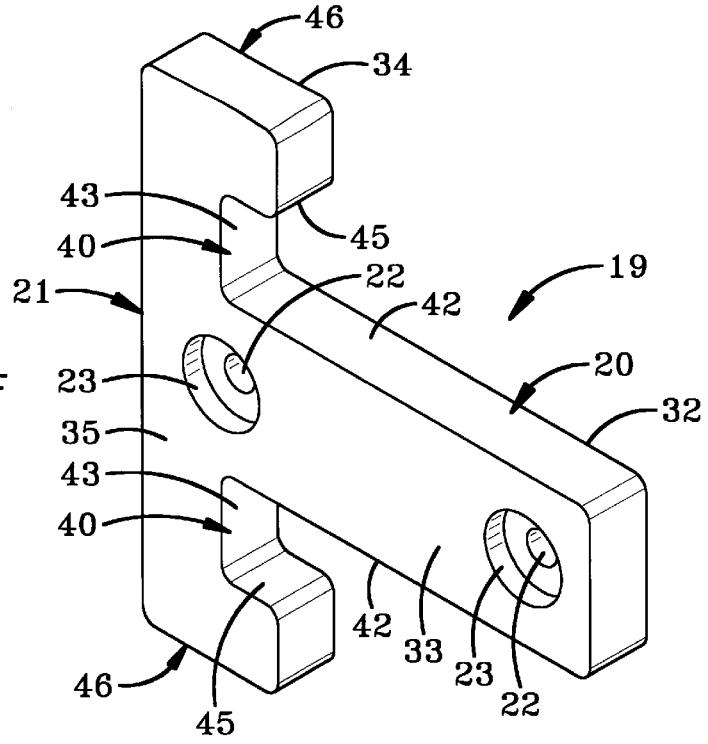
FIG. 4 is an enlarged perspective view of the T-shaped latch bar of the embodiment shown in FIG. 2.

FIG. 1 is a diagrammatic elevational view of an induction furnace indicated generally at 1, consisting of a refractory lined vessel 2 for containing metal which is turned into a molten state by an induction coil indicated generally at 3. Coil 3 consists of a plurality of windings collectively indicated at 4. Top and bottom windings 5 and 6 respectively, are connected to a source of electrical power by power lines 8 and 9 at coil terminations 11 and 12, respectively. Furnace 1 can be various types of induction melting and heating equipment than that shown in FIG. 1 without effecting the concept of the invention.

In accordance with the invention an improved clamp assembly, indicated generally at 15 is used to secure selected coil windings together, and preferably is located adjacent each coil termination 11 and 12 on top and bottom windings 5 and 6, for securing these windings in a fixed position with respect to the adjacent windings and to prevent axial or radial movement thereof.

Figure 7:
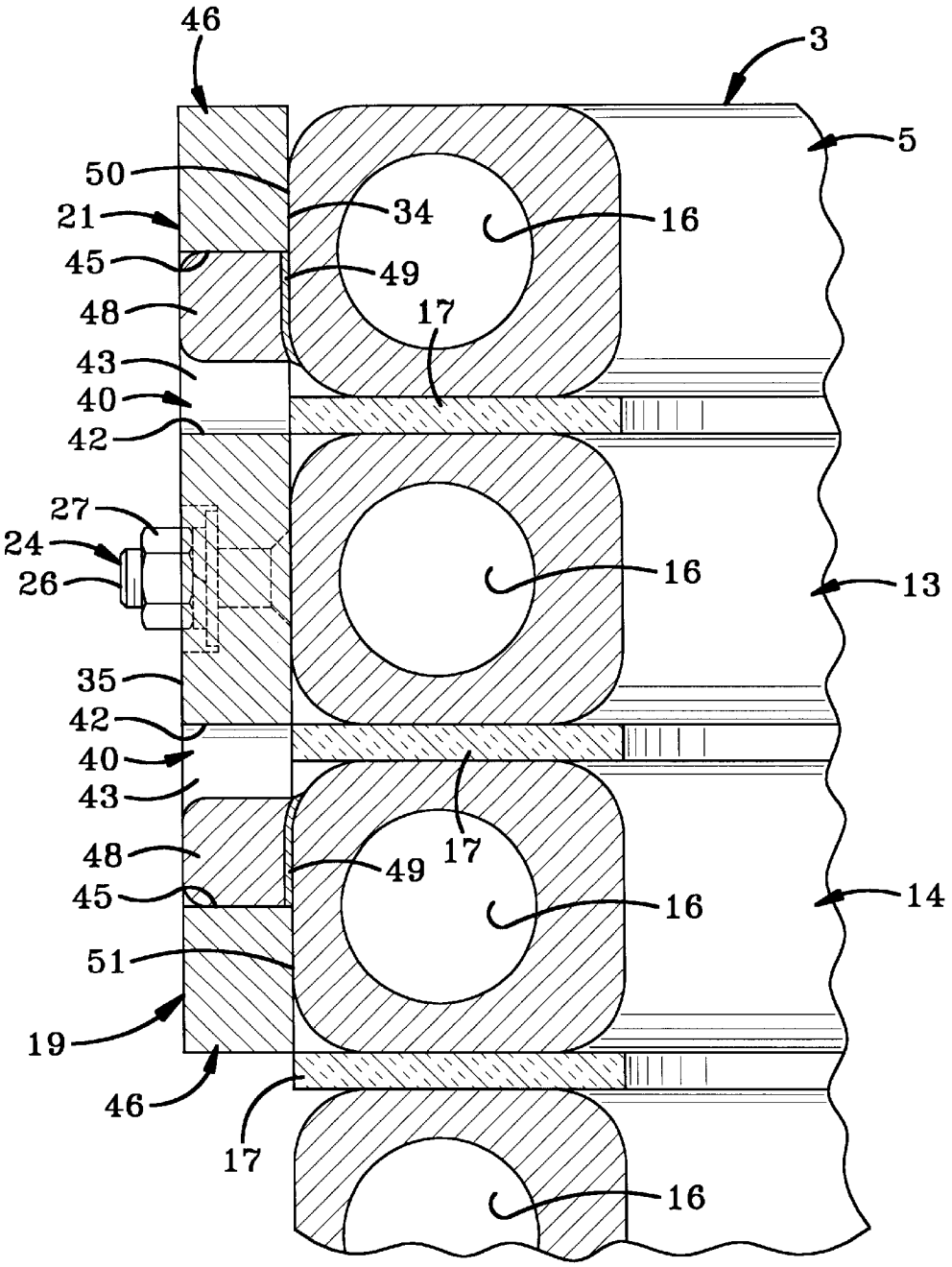
FIG. 7 is an enlarged fragmentary sectional view taken on line 7—7, FIG. 2.

The induction coil consists of a plurality of windings which preferably are formed with a generally circular or rectangular configuration as shown in FIG. 7. The windings are formed of a current carrying material such as copper, and preferably have internal cooling passages 16 through which a cooling agent, such as water, will flow keeping the coil material at an acceptable temperature level. The individual turns or windings of the coil are separated from each other by insulation 17 as in a usual induction coil.

Figure 6:
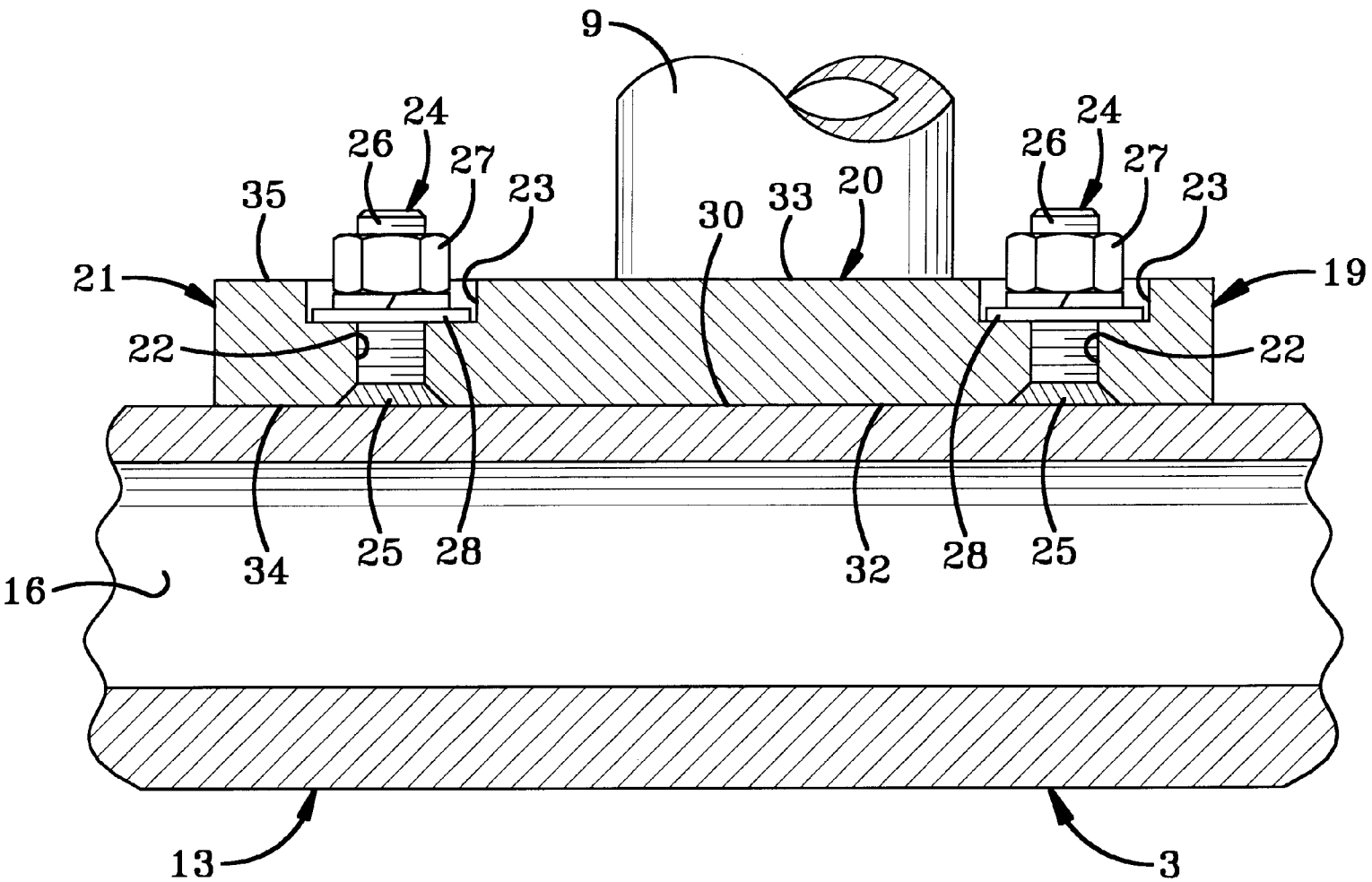
FIG. 6 is an enlarged fragmentary sectional view taken on line 6—6, FIG. 2.

FIG. 1 discloses a pair of the improved clamp assemblies 15 located at the top and bottom of the induction coil and extending across and connected to the end most windings 5 and 6 and the two adjacent windings 13 and 14. These clamp assemblies are similar to each other and thus, only one is described in detail and shown in the drawings. A first embodiment of the clamp assembly is shown in FIGS. 2, 4, 6 and 7 and includes a generally T-shaped latch bar 19, having a stem 20 and a cross member 21. Latch bar 19 is formed of a high strength, high temperature, high dielectric, high pressure, glass reinforced laminate. A pair of spaced holes 23 are formed in stem 20 for receiving a pair of stud bolts 24 which are mounted on the second winding 14 by welds 25 (FIG. 6). Stud bolts 24 will have a threaded outer end 26 for receiving a nut 27 thereon to clamp stem 20 tightly against winding 14. Preferably, a washer 28 will be placed within a counterbore 23 with stud bolts 24 extending through hole 22. Thus, the stud bolts and associated nuts 27 will tightly clamp stem 20 tightly against outer surface 30 of second winding 14. Stem 20 preferably will have inner and outer flat planar parallel surfaces 32 and 33 which lie in the same plane as flat planar inner surface 34 and 35 of cross member 21.

Cross member 21 of latch bar 19 includes a pair of ends 46 which extend parallel with stem 20 and form two U-shaped notches 40 therebetween. Notches 40 are formed by flat edge surfaces 42 of stem 20, underside surfaces 43 of cross member 21, and flat inner planar surfaces 45 of ends 46. Surfaces 43 preferably forms right angles with surfaces 42 and 45.

A pair of rectangular shaped axially aligned lugs 48 are secured by welds 49 to the generally flat outer surface 50 of top winding 5 and flat outer surface 51 of third winding 14 (FIG. 7). Lugs 48 are complementary to and are received in notches 40 and prevent axial as well as radial movement of end winding 5 with respect to second and third windings 13 and 14 to securely retain terminal winding 5 in a fixed position. Cross member 21 extends across second winding 13 and between first and third winding 5 and 14 as shown in FIGS. 2 and 7. The latch bar rests on the flat outer faces or surfaces of the three windings where it is kept cool by the cooling water flowing through passages 16.

The location of latch bar 19 avoids exposure to heat generated from the cast rings or furnace lining as heretofore occurred with the prior art tie-bolt assembly. Furthermore, lugs 48 which are fixed to the first and third windings, are of a relatively small mass and are located on the outer surface of the windings as shown in FIG. 7 and are less susceptible to radial flux as the prior art tie-bolt assembly. Thus, the lugs will not inductively heat and cause thermal degradation of the insulating qualities of latch bar 19. The latching lug on terminal winding 5 takes nearly the entire radial stress load and eliminates placing any strain on power connection or terminal 11. Likewise, there are no insulated through-bolts to arc out since stud bolts 24 are located within the insulating material of latch bar 19.

Figure 5:
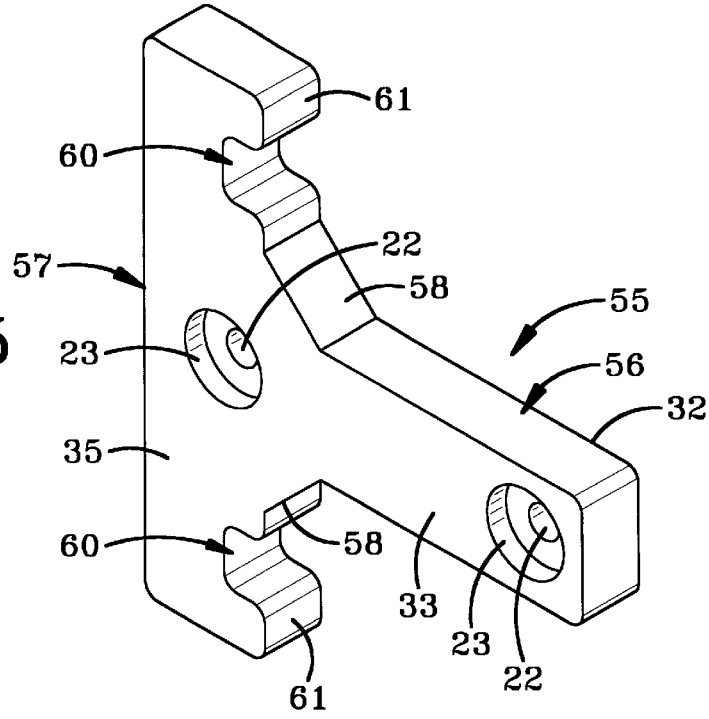
FIG. 5 is an enlarged perspective view of the modified latch bar of the embodiment shown in FIG. 3.

A slightly modified form of the T-shaped latch bar is indicated at 55, and shown in Figs.3 and 5. Latch bar 55 is similar to latch bar 19 described above except that stem 56 is connected to the cross member 57 by tapered surfaces 58. A pair of U-shaped notches 60, similar to notches 40 discussed above, are formed in the underside surface 61 of cross member 57 for receiving the rectangular shaped copper lugs 48 for latching and securing the first and third windings 5 and 14 respectively, in a secure position preventing both radial and axial movement with respect to second winding 13 on which stem 56 is secured by stud bolts 24 and nuts 27 as described above.

Accordingly, the improved clamp assembly for an induction furnace is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the clamp assembly for an induction furnace is constructed and used, the characteristics of the construction, and the advantageous new and useful results obtained; the new and useful structures, devices, elements, arrangements, parts, and combinations are set forth in the appended claims.

What is claimed is:

1. A clamp assembly for selected windings of an induction furnace coil comprising:

a generally T-shaped latch bar having a stem and a cross member, said latch bar being formed of a high strength dielectric composite material;

a fastener for securing the stem of the latch bar on one of the windings of the coil; and a pair of lugs adapted to be secured to two other windings which are located adjacent to the said one winding, each of said lugs being adapted to be engaged with end portions of the cross member to restrict axial movement of said windings.

2. The clamp assembly defined in claim 1 wherein the fastener includes a pair of stud bolts adapted to be secured to the said one winding and extending through a pair of holes formed in the stem of the latch bar.

3. The clamp assembly defined in claim 2 wherein the holes are formed with counterbores; and in which outer ends of the stud bolts are threaded and are engageable by nuts located in the counterbores.

4. The clamp assembly defined in claim 1 wherein the cross member is formed with a pair of notches located adjacent outer ends of said cross member; and in which the lugs are received in said notches.

5. The clamp assembly defined in claim 4 wherein each of the lugs has a generally rectangular configuration and the notches each have at least two straight sides forming a generally right angle therebetween for engaging a respective one of said lugs.

6. The clamp assembly of claim 5 wherein each of the notches has a U-shaped configuration.

7. The clamp assembly of claim 1 wherein the cross member terminates in a pair of ends having portions extending parallel with and spaced from the stem.

8. The clamp assembly of claim 7 wherein the end portions of the cross member form notches with said cross member; and in which the lugs are received in said notches.

9. The clamp assembly of claim 8 wherein each of said notches is formed by a side surface of a respective one of the end portions and an inner surface of the cross member which form a right angle therebetween.

10. The clamp assembly of claim 1 wherein a pair of tapered surfaces extend between the stem and cross member; in which a pair of spaced U-shaped notch is formed in said cross member; and in which the lugs are seated in said notches.

11. The clamp assembly of claim 1 wherein the stem and cross member each have flat inner and outer surfaces which lie in two common parallel planes.

12. The clamp assembly of claim 1 wherein each of the lugs is formed of copper and is adapted to be secured to a face surface of the two other windings of said end windings by a welded connection.

13. In combination, an induction furnace having an induction coil surrounding a crucible, said coil having at least first, second and third windings and a clamp assembly for securing together said windings;

said clamp assembly comprising a generally T-shaped latch bar having a stem extending along a portion of the second winding and a cross member extending in a generally axial direction with respect to the induction coil between the first and third windings and across said second winding;

a fastener securing the stem of the latch bar to the second winding; and a pair of lugs formed on the first and third windings and engaged with end of the cross member to restrict axial movement of said three windings with respect to each other.

14. The clamp assembly of claim 13 in which the latch bar is formed of a high strength, dielectric composite material.

15. The combination defined in claim 13 wherein each of the lugs is formed of copper and is secured to an outer face of the first and third windings by welded connections.

16. The combination defined in claim 13 wherein the cross member is formed with a pair of notches adjacent outer ends of said cross member; and in which the lugs are seated in said notches.

17. The combination defined in claim 16 wherein each of the lugs has a generally rectangular configuration and the notches each have at least two straight sides forming a generally right angle therebetween for engaging a respective one of said lugs.

18. The combination defined in claim 17 wherein each of the notches has a U-shaped configuration.

19. The combination defined in claim 13 wherein a pair of tapered surfaces extend between the stem and cross member; in which a pair of spaced U-shaped notch is formed in said cross member; and in which the lugs are seated in said notches.

* * * * *

UNITED STATES PATENT AND TRADEMARK OFFICE

CERTIFICATE OF CORRECTION

PATENT NO. : 6,434,182 B1
DATED : August 13, 2002
INVENTOR(S) : Mark L. Kohler

It is certified that error appears in the above-identified patent and that said Letters Patent is hereby corrected as shown below:

Title page,
Item [73], Assignee, change "Lecrotherm, Inc." with -- Lectrotherm, Inc. --

Signed and Sealed this

Fourth Day of February, 2003

JAMES E. ROGAN
*Director of the United States Patent and Trademark Office*